US005796315A

United States Patent [19]

Gordon et al.

[11] Patent Number: 5,796,315

[45] Date of Patent: Aug. 18, 1998

[54] RADIO FREQUENCY CONNECTOR WITH INTEGRAL DIELECTRIC COATING FOR DIRECT CURRENT BLOCKAGE

[75] Inventors: Robert B. Gordon, Springfield, Pa.; Robert C. Doak, Mount Laurel, N.J.; James L. Shields, Ambler, Pa.

[73] Assignee: Tracor Aerospace Electronic Systems, Inc., Lansdale, Pa.

[21] Appl. No.: 673,998

[22] Filed: Jul. 1, 1996

[51] Int. Cl.[6] ..... H01P 1/04

[52] U.S. Cl. ..... 333/24 C; 333/260; 439/578; 439/581

[58] Field of Search ..... 333/24 C, 260; 439/63, 578, 581

[56] References Cited

U.S. PATENT DOCUMENTS

| | | | |
|---|---|---|---|
| 3,087,129 | 4/1963 | Maury et al. | 333/260 |
| 3,309,632 | 3/1967 | Trudeau | 333/260 X |
| 3,617,607 | 11/1971 | Williams | 333/24 C X |
| 3,980,976 | 9/1976 | Tadama et al. | 333/24 C X |
| 4,229,714 | 10/1980 | Yu | 333/12 |
| 5,073,761 | 12/1991 | Waterman et al. | 333/24 C |

FOREIGN PATENT DOCUMENTS

| | | |
|---|---|---|
| 244657 | 11/1987 | European Pat. Off. . |
| 2651618 | 3/1991 | France . |

OTHER PUBLICATIONS

News Release, "star-tronics", Georgetown, Massachusetts, undated.

Microwave Journal, "Evolution of Precision Coaxial Connectors", Tore N. Anderson, Jan. 1968.

Sealectro, Sub-Miniature R.F. Connectors, 1961.

IBM Technical Disclosure Bulletin, "Connector for Solid Logic Technology", Bauman, Davis, kendrick, Seraphim, vol. 22 , No. 8B, Jan. 1980.

IBM Technical Disclosure Bulletin, Multistage Through-Hole, Uberbacher, vol. 10, No. 7, Dec. 1967.

IBM Technical Disclosure Bulletin, "Shredded In-Line Electrical Multiconnector", Strauss, vol. 10, No. 3 Aug. 1967.

The MicroWave Journal, "The Coaxial Connector Revolution", Cohn, Oct. 1964.

*Primary Examiner*—Paul Gensler

*Attorney, Agent, or Firm*—Seidel, Gonda, Lavorgna & Monaco, PC

[57] ABSTRACT

The present invention is directed to an electrical connector for blocking direct current while permitting transmission of alternating currents. The connector includes a first connector member and a second connector member for matingly receiving the first connector member. The first connector member includes a first conductor and the second connector member having a second conductor. The first and second conductors are positioned adjacent to one another and spaced apart by a layer of dielectric material. The dielectric material provides capacitive coupling of alternating currents from one conductor to the other while preventing coupling of direct current from one to the other. It is an object of the present invention to provide an improved electrical connector with an integral dielectric coating for direct current blockage.

7 Claims, 2 Drawing Sheets

RADIO FREQUENCY CONNECTOR WITH INTEGRAL DIELECTRIC COATING FOR DIRECT CURRENT BLOCKAGE

FIELD OF THE INVENTION

This invention relates generally to radio frequency (RF) connector assemblies and more particularly to an RF connector assembly with an integral dielectric coating for blocking direct current (DC) flow.

BACKGROUND OF THE INVENTION

Connectors associated with RF communication systems typically use coaxial transmission line systems to conduct RF signals from one point to another. These coaxial transmission line systems employ connectors at their ends to connect the transmission line system to additional coaxial transmission line systems or various RF circuit assemblies.

Connectors associated with multi-axial RF transmission line systems are commonly employed to interconnect RF circuits which are typically enclosed in metalized assembly housings. Traditionally, RF connectors for multi-axial systems include at least one concentric axial inner conductor and one concentric axial outer conductor. Multi-axial transmission systems having a single inner conductor (coaxial) and two inner conductors (triaxial) are well known.

A typical coaxial RF transmission line system has a center conductor and an outer conductor that terminate in a coaxial connector. Typically, the coaxial connector has a center conductor in electrical contact with the transmission line's center conductor, and a concentric axial outer conductor in electrical contact with the outer conductor of the transmission line. The opposite end of the coaxial connector is typically connected to a second RF connector that leads to another RF transmission line or RF circuit, which is connected to the outer conductor of the second RF connector. For the case of an RF circuit, the outer conductor of the connector is typically connected to a metalized housing in which the RF circuit is contained, and which is generally an electrical equipotential or ground. The equipotential or ground may have conducted or inducted undesirable electromagnetic energy referred to as noise energy that, if possible, should be isolated from the interconnected RF systems.

In addition to the problem of noise energy, other problems associated with RF transmission line systems include ground loops and transient low frequency energy conducted or inducted onto the outer conductor of the transmission line. Ground loops can generate noise energy from current flow or voltage drops between devices that have different potential levels. In addition, conducted or inducted transient low frequency energy can be conducted by the transmission line to the interconnected RF circuits, causing interference or even destruction of the intended information signal or RF components at the end of the transmission line.

It is an object of the present invention to substantially reduce or eliminate noise energy, low frequency energy, and ground loops that might be otherwise conducted or formed from one transmission line system or RF housing to another. In the present invention, an electrical connector for blocking direct current while permitting transmission of desired alternating current is established by isolating the exterior connected member of one connector from the exterior member of a second connector member. The isolation is achieved by a thin and durable coating of dielectric material that covers either or both of the outer connector members of standard RF connector assemblies. It is another object of the present invention to incorporate commonly available dielectric materials and processes to provide an inexpensive and effective method for isolating the exterior connected members of standard RF connector assemblies.

In the prior art, several attempts have been made to provide low frequency isolation between the inner and outer conductors of a connector. For example, U.S. Pat. No. 4,229,714 discloses a coaxial connector assembly having an inner and outer conductor. The outer conductor further comprises a washer like capacitor fitted over its surface for low frequency isolation between the inner and outer conductors and for reducing the aura of currents on the outer conductor. This device provides very limited low frequency isolation, and only at the extreme ends of each inner and outer connector. The washer type isolator disclosed cannot be easily applied, if at all, to standard RF connectors. Most standard RF connector assemblies are not designed to accommodate additional parts such as the device disclosed in the '714 patent.

In U.S. Pat. No. 5,073,761, a non-conducting RF coupler connector is disclosed. The connector comprises a housing having first and second housing portions. Each housing portion is used to initiate an electromagnetic signal between the housing assemblies. The first and second housing portions are separated by a dielectric material, thereby providing a non-contact connection through capacitive coupling. This device incorporates non-standard bulky housing assemblies that are not suitable for transmission line systems and most RF circuit housings.

In European Patent Application 0244657, a T-shaped coaxial BNC-type connector is disclosed having a conductive housing that is selectively coated with an insulating material for preventing external grounds when incorporated into an assembly having adjacent grounded electrical equipment. This device only provides insulation between adjacent conductive housings associated with RF equipment.

Thus, there is a need for a standard connector assembly, without additional parts or bulky housings, that can substantially reduce or eliminate noise energy, low frequency energy, and ground loops that might be otherwise conducted or induced on a transmission line system or RF housing. In addition, there is a need for a connector assembly for blocking direct current while permitting transmission of desired alternating current by isolating an exterior conductive member of one connector from the exterior conductive member of a second connector member.

There is a need for a connector having a thin and durable coating of dielectric material that covers either or both of the outer connector members of standard RF connector assemblies for isolating them from each other. In addition, there is a need for an inexpensive and effective method for isolating the exterior connected members of standard RF connector assemblies incorporating commonly available dielectric materials and processes.

Thus, there is still a need for an electrical connector for blocking direct current while permitting transmission of alternating currents for RF transmission line systems. The present invention fills that need.

SUMMARY OF THE INVENTION

The present invention is directed to an electrical connector for blocking direct current while permitting transmission of alternating currents. The connector includes a first connector member and a second connector member for matingly receiving the first connector member. The first connector member includes a first conductor, and the second connector member includes a second conductor. The first and second conductors are positioned adjacent to one another and spaced apart by a layer of dielectric material. The dielectric material provides capacitive coupling of alternating currents from one conductor to the other while preventing coupling of direct current from one to the other.

It is an object of the present invention to provide an improved electrical connector with an integral dielectric coating for direct current blockage. This and other features, aspects, and advantages of the present invention will become better understood with reference to the following descriptions, drawings, and appended claims.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE PREFERRED EMBODIMENT

While the invention will be described in connection with a preferred embodiment, it will be understood that it is not intended to limit the invention to that embodiment. On the contrary, it is intended to cover all aspects, alternatives, modifications and equivalents as may be included within the spirit and scope of the invention as defined by the appended claims.

Figure 1:
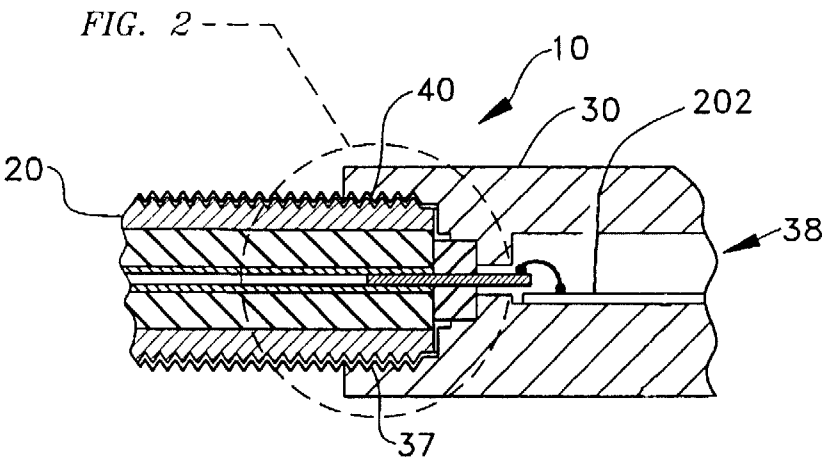
FIG. 1 is a cross-sectional view of a connector with integral dielectric coating according to a preferred embodiment of the present invention.

Referring to the drawings in detail, wherein like numerals indicate like elements, FIG. 1 shows a connector according to a preferred embodiment of an RF connector 10 with an integral dielectric coating. The connector 10 comprises a first connector member 20 and a second connector member 30 having a threaded bore 37 in a RF circuit housing 38. The second connector member 30 matingly receives the first connector member 20. As described above, the RF circuit housing 38 is typically used as a ground or equipotential reference for an RF circuit 202 within the circuit housing 38, and as a ground or equipotential reference for a transmission line system (not shown) or RF circuit assembly (not shown) that may be connected to the first connector member 20. A layer of dielectric material 40 separates the first connector member 20 from the second connector member 30.

Figure 2:
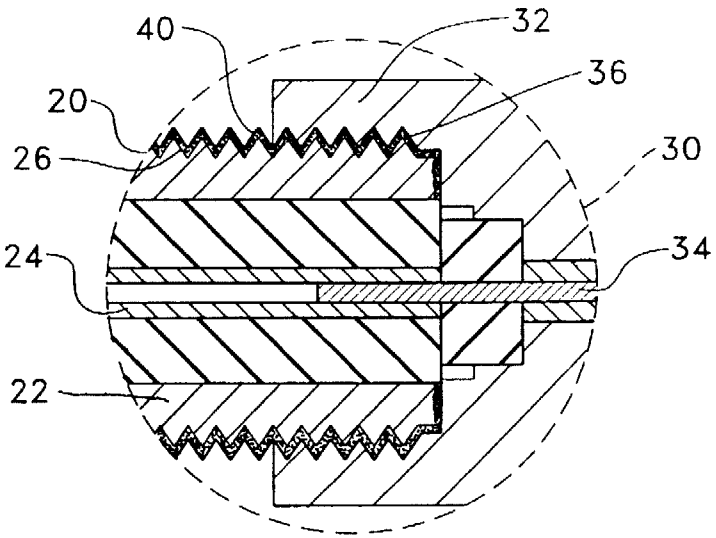
FIG. 2 is an enlarged view of a portion of the connector shown in FIG. 1.

Referring to FIG. 2, the first connector member 20 has an outer conductor 22 and a center conductor 24. The second connector member 30 matingly receives the first connector member 20. The second connector also includes an outer conductor 32 and a center conductor 34. When the first and second connector members 20,30 are mated, the first and second outer conductors 22,32 mechanically engage each other and are spaced apart by a layer of dielectric material 40. It is to be understood that the first and second connector members 20,30 can be integral with RF circuit housings or transmission line systems.

The dielectric material 40 is located between the first outer conductor 22 and the second outer conductor 32, and permits capacitive coupling of alternating currents from one outer conductor to the other while preventing coupling of direct current from one to the other.

The dielectric material 40 can be any dielectric that provides a desired resistance of at least 0.10 ohm. The material may comprise alone or in combination dielectric materials such as aluminum oxide, silicone, polyethylene, polyimide, epoxy, polyester, and non-conductive plastic. It is to be understood that the foregoing list of dielectric materials is only representative and that any dielectric material that can be applied to the connector would be acceptable.

The dielectric material 40 can be applied to coat the first outer conductor 22 and/or the second outer conductor 32 by any known method. For example, the dielectric material 40 can be applied to either conductor 22,32 by methods such as, but not limited to, electrolytic growth, vacuum deposition, vapor deposition, sputtered coating, spray coating, machined fitted coating, and dip coating. It is to be understood that the foregoing list of methods is only representative and that any method can be used to apply the dielectric material 40 to either conductor 22,32.

In one aspect of the invention as shown in FIG. 2, the first connector member 20 has a threaded outer surface 26 that is substantially coated with the dielectric material 40. In another aspect (not shown) of the invention, the second connector member 30 has a threaded inner surface 36 substantially coated with said dielectric material 40.

Figure 3:
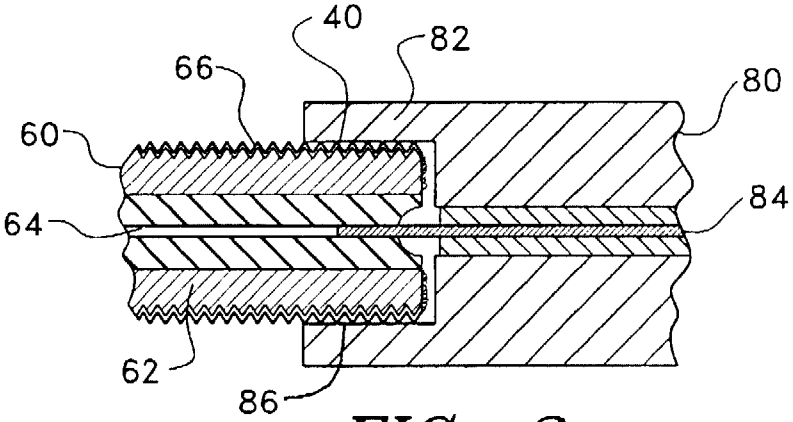
FIG. 3 is a cross-sectional view of a connector with integral dielectric coating according to an alternate embodiment of the present invention.

Referring to FIG. 3 showing an alternate embodiment of the present invention, a first connector member 60 having a first outer conductor 62 is frictionally retained by a second connector member 80 having a second outer conductor 82. It is to be understood that the first and second connector members 60,80 can be integral with RF circuit housings or transmission line systems.

In one aspect of the alternate embodiment shown in FIG. 3, the first connector member 60 has a first conductive friction mating surface 66 that is substantially coated with the dielectric material 40. In another aspect (not shown) of the alternate embodiment, the second connector member 80 has a second conductive friction mating surface 86 that is substantially coated with the dielectric material 40. In yet another aspect (not shown) of the alternate embodiment, the first connector member 60 and the second connector member 80 are both coated with the dielectric material 40 at their respective friction mating surfaces 66,86.

As shown in FIG. 3, the first connector member 60 includes a first center conductor 64, and the second connector member 80 includes a second center conductor 84. When the first connector member 60 and the second connector member 80 are mated, the outer conductor 82 mechanically engages the first outer conductor 62 and are retained together by the first and second friction mating surfaces 66,86. When the first connector member 60 mates with the second connector member 80, the center conductor 64 conductively engages the center conductor 84.

The dielectric material 40 separates the first outer conductor 62 from the second outer conductor 82. The dielectric material 40 is applied to the first friction mating surface 66. However, it is understood that either or both friction mating surfaces 66,86 can be coated with the dielectric material 40 as required to achieve a desired level of electromagnetic isolation between the first and second connector members 60,80.

Figure 4:
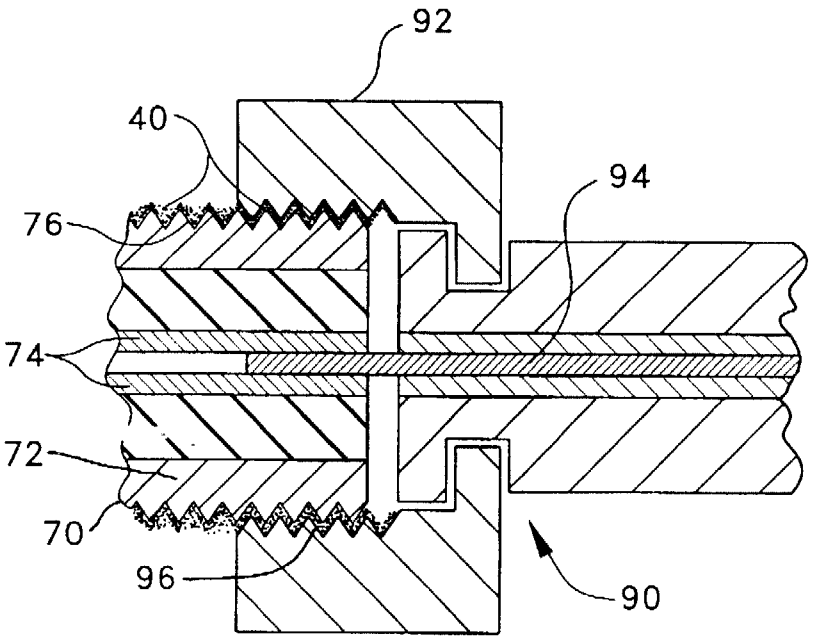
FIG. 4 is a cross-sectional view of a connector with integral dielectric coating according to an alternate embodiment of the present invention.

Referring to FIG. 4 showing another alternate embodiment of the present invention, a first connector member 70 has an outer conductor 72 and a center conductor 74. A second connector member 90 matingly receives the first connector member 70. The second connector member 90 also includes an outer conductor 92 and a center conductor 94. When the first connector members 70,90 are mated, the first and second outer conductors 72,92 mechanically engage each other and are spaced apart by a layer of dielectric material 40. It is to be understood that the first and second connector members 70,90 can be integral or movably connected with RF circuit housings or transmission line systems.

The dielectric material 40 is located between the outer conductor 72 and the outer conductor 92, and permits capacitive coupling of alternating currents from one outer conductor to the other while preventing coupling of direct current from one to the other.

The dielectric material 40 can be applied to coat the first outer conductor 72 and/or the second outer conductor 92 by any known method. For example, the dielectric material 40 can be applied to either conductor 72,92 by the same methods described above.

In one aspect of the invention as shown in FIG. 4, the first connector member 70 has a threaded outer surface 76 that is substantially coated with the dielectric material 40. In another aspect (not shown) of the invention, the second connector member 90 has a threaded inner surface 96 substantially coated with said dielectric material 40.

Figure 5:
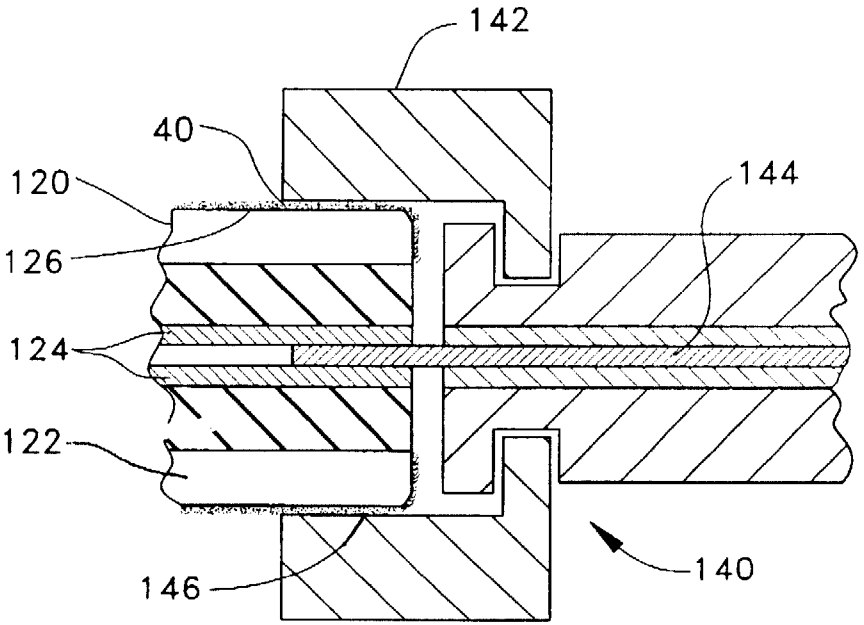
FIG. 5 is a cross-sectional view of a connector with integral dielectric coating according to an alternate embodiment of the present invention.

Referring to FIG. 5 showing yet another alternate embodiment of the present invention, a first connector member 120 having a first outer conductor 122 is frictionally retained by a second connector member 140 having a second outer conductor 142. It is to be understood that the first and second connector members 120,140 can be integral with RF circuit housings or transmission line systems.

In one aspect of the alternate embodiment shown in FIG. 5, the first connector member 120 has a first conductive friction mating surface 126 that is substantially coated with the dielectric material 40. In another aspect (not shown) of the alternate embodiment, the second connector member 140 has a second conductive friction mating surface 146 that is substantially coated with the dielectric material 40. In yet another aspect (not shown) of the alternate embodiment, the first connector member 120 and the second connector member 140 are both coated with the dielectric material 40 at their respective friction mating surfaces 126,146.

As shown in FIG. 5, the first connector member 120 includes a first center conductor 124, and the second connector member 140 includes a second center conductor 144. When the first connector member 120 and the second connector member 140 are mated, the second outer conductor 142 mechanically engages the outer conductor 122 and are retained by the first and second friction mating surfaces 126,146. When the first connector member 120 mates with the second connector member 140, center conductor 124 conductively engages the center conductor 144.

The dielectric material 40 separates the first outer conductor 122 from the second outer conductor 142. The dielectric material 40 is applied to the first friction mating surface 126. However, it is understood that either or both friction mating surfaces 126,146 can be coated with the dielectric material 40 as required to achieve a desired level of electromagnetic isolation between the first and second connector members 120,140.

It is to be understood that in all embodiments of the present invention, the dielectric material 40 can be applied in a manner that either partially or substantially covers either or both connector members. The amount of dielectric coating applied, type of dielectric material selected, and method of application is a matter of design choice which depends on the level of D.C. blockage desired and the desired operable RF frequency range.

The present invention may be embodied in other specific forms without departing from the spirit or essential attributes thereof and, accordingly, reference should be made to the appended claims, rather than to the foregoing specification, as indicating the scope of the invention.

What is claimed is:

1. A coaxial connector comprising a first connector member having a center conductor and an outer conductor concentrically surrounding and spaced apart from the center conductor, a second connector member for matingly receiving the first connector member and having a center conductor for mating directly with the center conductor of the first connector member and having an outer conductor concentrically surrounding and spaced apart from the center conductor for receiving therein the outer conductor of the first connector member, an integral dielectric coating material separating the outer conductor of the first connector member from the outer conductor of the second connector member, and said dielectric coating being applied by as method selected from a group consisting of electrolytic growth, vacuum deposition, vapor deposition, sputtered coating, spray coating, machined fitted coating, and dip coating.

2. A coaxial connector according to claim 1, wherein said dielectric coating is composed of a material selected from a group consisting of aluminum oxide, silicone, polyethylene, polyimide, epoxy, polyester, and non-conductive plastic.

3. A coaxial connector according to claim 1, wherein said dielectric coating substantially covers the outer conductor of the first connector member.

4. A coaxial connector according to claim 1, wherein said dielectric coating substantially covers the outer conductor of the second connector member.

5. A coaxial connector according to claim 1, wherein said first connector member has a threaded outer surface substantially coated with said dielectric coating.

6. A coaxial connector according to claim 1, wherein said second connector member has a threaded inner surface substantially coated with said dielectric coating.

7. A coaxial connector according to claim 1, wherein said first connector member is frictionally retained by said second connector member.

* * * * *